US005670466A

United States Patent [19]

Sivik et al.

[11] Patent Number: 5,670,466

[45] Date of Patent: Sep. 23, 1997

[54] SULFONATE PERFUMES FOR LAUNDRY AND CLEANING COMPOSITIONS

[75] Inventors: Mark Robert Sivik, Fairfield; Frederick Anthony Hartman, Cincinnati, both of Ohio

[73] Assignee: The Procter & Gamble Company, Cincinnati, Ohio

[21] Appl. No.: 574,754

[22] Filed: Dec. 20, 1995

[51] Int. Cl.[6] ..... D06M 13/256

[52] U.S. Cl. ..... 510/102; 510/101; 510/346; 510/515; 510/516

[58] Field of Search ..... 510/346, 515, 510/516, 101, 102

[56] References Cited

U.S. PATENT DOCUMENTS

| | | | |
|---|---|---|---|
| 4,395,363 | 7/1983 | Crawford | 510/346 |
| 5,366,665 | 11/1994 | Cho | 252/549 |
| 5,378,468 | 1/1995 | Suffis et al. | 424/401 |
| 5,470,493 | 11/1995 | Daunte et al. | 510/515 |
| 5,531,910 | 7/1996 | Severns et al. | 510/102 |
| 5,559,088 | 9/1996 | Severns et al. | 510/102 |
| 5,562,847 | 10/1996 | Waite et al. | 510/519 |

*Primary Examiner*—Ellen M. McAvoy
*Attorney, Agent, or Firm*—Thomas G. Krivulka

[57] ABSTRACT

Sulfonates of perfume alcohols are provided. The sulfonates have the general formulas of (I), (II), or combinations thereof:

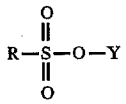

(I)

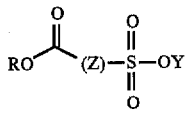

(II)

wherein R and Z are independently selected from the group consisting of nonionic or anionic, substituted or unsubstituted $C_1$–$C_{30}$ straight, branched or cyclic alkyl, alkenyl, alkynyl, alkylaryl or aryl group; Y is a radical that, upon hydrolysis of said sulfonate, forms an alcohol with a boiling point at 760 mm Hg of less than about 300 °C. which are perfumes. The sulfonates are employed as perfume components in laundry and cleaning compositions such as fabric softening compositions.

19 Claims, No Drawings

SULFONATE PERFUMES FOR LAUNDRY AND CLEANING COMPOSITIONS

FIELD OF THE INVENTION

The present invention relates to laundry and cleaning products comprising sulfonates of alcohol perfumes.

BACKGROUND OF THE INVENTION

Consumer acceptance of cleaning and laundry products is determined not only by the performance achieved with these products but the aesthetics associated therewith. The perfume systems are therefore an important aspect of the successful formulation of such commercial products.

What perfume system to use for a given product is a matter of careful consideration by skilled perfumers. While a wide array of chemicals and ingredients are available to perfumers, considerations such as availability, cost, and compatibility with other components in the compositions limit the practical options. Thus, there continues to be a need for low-cost, compatible perfume materials useful for cleaning and laundry compositions.

It has been discovered that sulfonates of certain perfume alcohols are particularly well suited for laundry and cleaning compositions. In particular, it has been discovered that sulfonates of perfume alcohols will hydrolyze to give an alcohol perfume and the corresponding salt. In addition, hydrolyzable sulfonates of perfume alcohols provide release of the perfume over a longer period of time than by the use of the perfume itself in the laundry/cleaning compositions. Such materials therefore provide perfumers with more options for perfume ingredients and more flexibility in formulation considerations. These and other advantages of the present invention will be seen from the disclosures hereinafter.

BACKGROUND ART

Sulfonate chemistry is described more generally in March, Advanced Organic Chemistry, 4th Ed., pp. 352–353, 372, 404–405, 498–499 (John Wiley & Sons, N.Y.; 1992).

Compositions of fragrance materials (having certain values for Odour Intensity Index, Malodour Keduction Value and Odour Reduction Value) said to be used as fragrance compositions in detergent compositions and fabric conditioning compositions are described in European Patent Application Publication No. 404,470, published Dec. 27, 1990 by Unilever PLC. A process for scenting fabrics washed with lipase-containing detergents including esters of alcohol perfumes is described in PCT application No. WO 95/04809, published Feb. 16, 1995 by Firmenich S. A.

SUMMARY OF THE INVENTION

The present invention relates to laundry and cleaning compositions having a perfume component. The perfume component includes at least about 0.01% by weight of a sulfonate of a perfume alcohol. The sulfonates of the present invention provide a superior consumer noticeable benefit to fabrics laundered in the compositions of the present invention.

Accordingly, a laundry and cleaning composition is provided by the present invention. The composition comprises a perfume component having sulfonate and/or sulfonates of perfume alcohol and/or alcohols at a level effective to provide a perfume effect. The sulfonates have the general formulas of (I), (II), or combinations thereof:

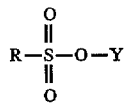

(I)

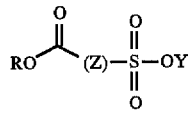

(II)

wherein R and Z are independently selected from the group consisting of nonionic or anionic, substituted or unsubstituted $C_1$–$C_{30}$ straight, branched or cyclic alkyl, alkenyl, alkynyl, alkylaryl or aryl group; Y is a radical that, upon hydrolysis of said sulfonate, forms an alcohol with a boiling point at 760 mm Hg of less than about 300° C. that is a perfume.

The perfume component comprises from about 0.01% to about 10% by weight of the laundry and cleaning composition.

The composition also includes ingredients useful for formulating laundry and cleaning compositions. The ingredients are selected, e.g., from the group consisting of: eationic or nonionic fabric softening agents, enzymes, enzyme stabilizers, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof.

In accordance with another aspect of the present invention, a fabric softening composition is provided. The fabric softening composition comprises a perfume component at a concentration of from about 0.01% to about 10% by weight of the fabric softening composition. In addition, the fabric softening composition includes a fabric softening component having at least one cationic or nonionic fabric softening agent.

The fabric softening composition can further optionally include, e.g., at least one compound selected from the group consisting of viscosity/dispersibity modifiers, pH modifiers and liquid carriers. The dispersibility modifier is selected from the group consisting of: single-long-chain-$C_{10}$–$C_{22}$ alkyl, cationic surfactant; nonionic surfactant with at least 8 ethoxy moieties; amine oxide surfactant; quaternary ammonium salts of the general formula:

$$(R^2N^+R_3)\ X^-$$

wherein the $R^2$ group is a $C_{10}$–$C_{22}$ hydrocarbon group, or the corresponding ester linkage interrupted group with a short alkylene ($C_1$–$C_4$) group between the ester linkage and the N, and having a similar hydrocarbon group, each R is a $C_1$–$C_4$ alkyl or substituted alkyl, or hydrogen; and the counterion $X^-$ is a softener compatible anion, and mixtures thereof.

The fabric softening component is preferably a cationic quaternary ammonium fabric softening compound. Most preferably, it has the formula:

$$[(R)_{4-m}—^+N—((CH_2)_n—Y—R^2)_m]X^-$$

wherein: each Y is —O—(O)C—, or —C(O)—O—, m is 2 or 3; each n is independently chosen from 1 to 4; each R is a $C_1$–$C_6$ alkyl group, hydroxyalkyl group, benzyl group, or mixtures thereof; each $R^2$ is a $C_{12}$–$C_{22}$ hydrocarbyl or substituted hydrocarbyl substituent; and $X^-$ is any softener-compatible anion. The quaternary ammonium compound can be derived from $C_{12}$–$C_{22}$ fatty acyl groups having an Iodine Value of from greater than about 5 to less than about 100, a cis/trans isomer weight ratio of greater than about 30% when the Iodine Value is less than about 25, the level of unsaturation of the fatty acyl groups being less than about 65% by weight.

In accordance with yet another aspect of the present invention, a method for laundering soiled fabrics is provided. The method comprises contacting a fabric with an aqueous medium containing at least about 50 ppm of a laundry composition. The laundry composition includes a perfume component, according to formula (I, at a concentration of from about 0.01% to about 10% by weight of the laundry composition. In addition, the laundry composition used in the method includes ingredients useful for formulating laundry compositions. Such ingredients include cationic or nonionic fabric softening agents, enzymes, enzyme stabilizers, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof.

Accordingly, it is an object of the present invention to provide a laundry and cleaning composition having a perfume component including a sulfonate of a perfume alcohol. It is another object of the present invention to provide a fabric softening composition having a perfume component including a sulfonate of a perfume alcohol. It is still another object of the present invention to provide a method for cleaning soiled fabrics by contacting a fabric with a laundry composition having a perfume component including a sulfonate of a perfume alcohol. It is yet another object of the present invention to provide an ester of a perfume alcohol wherein the ester has at least one free carboxylate group. It is a feature of the present invention that a sulfonate of a perfume alcohol provide a superior consumer recognizable result to compositions in which they are included.

All percentages, ratios and proportions herein are on a weight basis unless otherwise indicated. All documents cited herein are hereby incorporated by reference.

DETAILED DESCRIPTION

The present invention relates to laundry and cleaning compositions having a perfume component. The composition comprises from about 0.01% to about 10% by weight of the laundry and cleaning composition of a perfume component comprising sulfonate and/or sulfonates of perfume alcohol and/or alcohols. The sulfonates have the general formulas (I), (II), or combinations thereof:

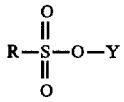

(I)

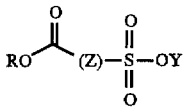

(II)

wherein R and Z are independently selected from the group consisting of nonionic or anionic, substituted or unsubstituted $C_1$–$C_{30}$ straight, branched or cyclic alkyl, alkenyl, alkynyl, alkylaryl or aryl group; Y is a radical that, upon hydrolysis of said sulfonate, forms an alcohol with a boiling point at 760 mm Hg of less than about 300° C. that is a perfume.

Preferably, R and Z are selected from the group consisting of substituted or unsubstituted $C_1$–$C_{20}$ straight, branched or cyclic alkyl, alkenyl, alkynyl, alkylaryl, aryl group or ring containing a herteroatom. Y is preferably a radical that upon hydrolysis of said sulfonate forms perfume alcohol selected from the group consisting of:

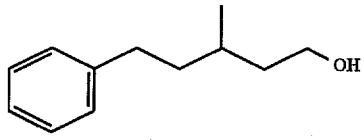

phenoxanol;

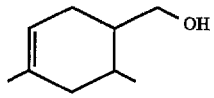

floralol;

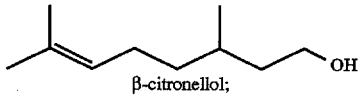

β-citronellol;

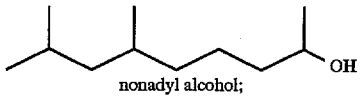

nonadyl alcohol;

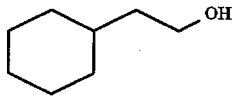

cyclohexyl ethanol;

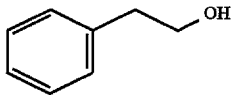

phenyl ethanol;

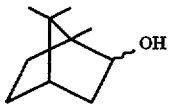

isoborneol;

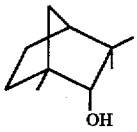

fenchol;

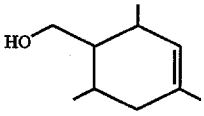

isocyclogeranol;

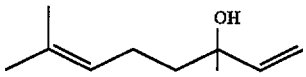

(±)-linalool;

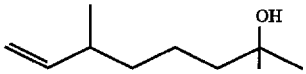

dihydromyrcenol;

-continued

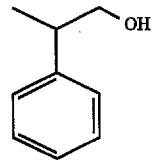

2-phenyl-1-propanol;

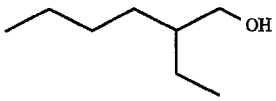

2-ethylhexanol;

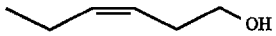

cis-3-hexenol

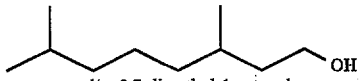

and/or 3,7-dimethyl-1-octanol.

The most preferred sulfonates are the p-toluenesulfonates (tosylates), 4-bromobenzenesulfonates (brosylates), and methanesulfonates (mesylates) of β-citronellol, phenoxanol, cis-3-hexenol, and phenyl ethanol.

Of course, one of ordinary skill in the art will recognize that other sulfonates satisfying the general formula (I) or (II) can also be employed in the present invention.

The perfume component of the compositions of the present invention can include one or more additional fully, or partially, esterified esters of a perfume alcohol in conjunction with the esters of formula (I) described above. Suitable fully esterified perfume alcohol esters which can be employed in the present invention are disclosed in U.S. Patent Application 08/277,558 to Hartman et al. filed on Jul. 19, 1994, now abandoned, U.S. patent application Ser. No. 08/499,158 to Severns et al. filed on Jul. 7, 1995, now U.S. Pat. No. 5,559,088; and U.S. patent application Ser. No. 08/499,282 to Severns et al. filed on Jul. 7, 1995, now U.S. Pat. No. 5,531,910 of which the disclosures of all three are herein incorporated by reference. Preferably, the fully esterified esters of perfume alcohols are di-esters of perfume alcohols. Di-esters of both allylic and non-allylic alcohols can be employed. Suitable fully esterified esters of perfume alcohols which can be employed in the present invention include digeranyl succinate, dineryl succinate, geranyl neryl succinate, geranyl phenylacetate, neryl phenylacetate, geranyl laurate, neryl laurate, di(b-citronellyl) maleate, dinonadol maleate, diphenoxanyl maleate, di(3,7-dimethyl-1-octanyl) succinate, di(cyclohexylethyl) maleate, difloralyl succinate, and di(phenylethyl) adipate and mixtures thereof.

The compositions of the present invention include liquid, granular and bar laundry and cleaning products, which are typically used for laundering fabrics and cleaning hard surfaces such as dishware and other surfaces in need of cleaning and/or disinfecting. Preferred are those laundry compositions which result in contacting the perfume component as described hereinbefore with fabric. These are to be understood to include not only detergent compositions which provide fabric cleaning benefits but also laundry compositions such as liquid or granular rinse added fabric softener compositions which provide softening and/or anti-static benefits. The perfume component typically comprises from about 0.01% to about 10%, preferably from about 0.05% to about 5%, and more preferably from about 0.1% to about 5%, by weight of the composition.

The liquid and granular fabric softener compositions preferred in the present invention can be added directly in the rinse of a laundry process both to provide adequate usage concentration, e.g., from about 10 to about 2,500 ppm, preferably from about 30 to about 2000 ppm, of the biodegradable, cationic fabric softener compound, or water can be pre-added to the particulate, solid, granular composition to form dilute or concentrated liquid softener compositions that can be added to the rinse to provide the same usage concentration.

The perfume component of compositions of the present invention can also include additional perfume ingredients in addition to the sulfonates of formula (I) and the esterified esters of perfume alcohols. Such additional perfume ingredients are well-known to those of ordinary skill in the art. Typical additional perfume compounds and compositions can be found in the art including U.S. Pat. Nos. 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

In addition, the present invention includes a method for laundering soiled fabrics. The method comprises contacting a fabric with an aqueous medium containing at least about 50 ppm of a laundry composition containing a perfume component of formula (I) as hereinbefore described. The laundry composition is formulated such that the aqueous medium in the laundering process has a pH of from about 6.5 to about 12. The laundering method is conducted for a period of time effective to impart the desired properties to the fabric such a soil or stain removal or fabric softening.

The compositions of the present invention can also optionally include ingredients useful for formulating laundry and cleaning compositions. Such ingredients include but are not limited to cationic or nonionic fabric softening agents, enzymes, enzyme stabilizers, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof. The compositions include both granular and liquid laundry and cleaning compositions.

The sulfonates of the present invention hydrolyze to generate the perfume alcohol thereby generating a pleasant odor. In this fashion, perfume alcohols can be delivered to the fabric surface as a sulfonate and then hydrolyze to the alcohol and release the pleasant odor.

Cationic or Nonionic Fabric Softening Agents:

The preferred fabric softening agents to be used in the present invention compositions are quaternary ammonium compounds or amine precursors herein having the formula (III) or (IV), below:

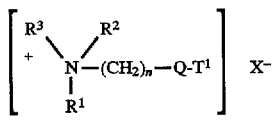

(III)

or

-continued

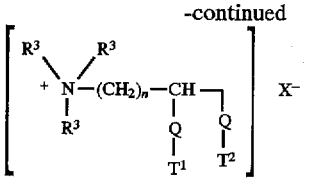

(IV)

wherein:

each Q is —O—C(O)— or —C(O)—O— or —O—C(O)—O— or —$NR^4$—C(O)— or —C(O)—$NR^4$—;

each $R^1$ is $(CH_2)_n$—Q—$T^2$ or $T^3$ or $R^3$;

each $R^2$ is $(CH_2)m$—Q—$T^4$ or $T^5$ or R3;

each R3 is $C_1$–$C_4$ alkyl or $C_1$–$C_4$ hydroalkyl or H;

each $R^4$ is H or $C_1$–$C_4$ alkyl or $C_1$–$C_4$ hydroalkyl;

$T^1$, $T^2$, $T^3$, $T^4$, $T^5$ are (the same or different) $C_{11}$–$C_{22}$ alkyl or alkenyl;

n and m are integers from 1 to 4; and

X- is a softener-compatible anion, such as chloride, methyl sulfate, etc.

The alkyl, or alkenyl, chain $T^1$, $T^2$, $T^3$, $T^4$, $T^5$ must contain at least 11 carbon atoms, preferably at least 16 carbon atoms. The chain can be straight or branched.

Q, n, $T^1$, and $T^2$ can be the same or different when more than one is present in the molecule.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred. Specific examples of quaternary ammonium compounds suitable for use in the aqueous fabric softening compositions herein include:

1) N,N-di(tallowyl-oxy-ethyl)-N,N-dimethyl ammonium chloride;

2) N,N-di(tallowyl-oxy-ethyl)-N-methyl, N-(2-hydroxyethyl) ammonium chloride;

3) N,N-di(2-allowyloxy-2-oxo-ethyl)-N,N-dimethyl ammonium chloride;

4) N,N-di(2-tallowyloxyethylcarbonyloxyethyl)-N,N-dimethyl ammonium chloride;

5)$_n$-(2-tallowoyloxy-2-ethyl)-N-(2-tallowyloxy-2-oxo-ethyl)-N,N-dimethyl ammonium chloride;

6) N,N,N-tri(tallowyl-oxy-ethyl)-N-methyl ammonium chloride;

7) N-(2-tallowyloxy-2-oxoethyl)-N-(tallowyl)-N,N-dimethyl ammonium chloride; and 8) 1,2-ditallowyloxy-3-N,N,N-trimethylammoniopropane chloride; and mixtures of any of the above materials.

Of these, compounds 1–7 are examples of compounds of Formula (III); compound 8 is a compound of Formula (IV).

Particularly preferred is N,N-di(tallowoyl-oxy-ethyl)-N,N-dimethyl ammonium chloride, where the tallow chains are at least partially unsaturated.

The level of unsaturation of the tallow chain can be measured by the Iodine Value (I.V.) of the corresponding fatty acid, which in the present case should preferably be in the range of from 5 to 100 with two categories of compounds being distinguished, having an I.V. below or above 25.

Indeed, for compounds of Formula (III) made from tallow fatty acids having a I.V. of from 5 to 25, preferably 15 to 20, it has been found that a cis/trans isomer weight ratio greater than about 3/70, preferably greater than about 5/50 and more preferably greater than about 7/30 provides optimal concentrability.

For compounds of Formula (HI) made from tallow fatty acids having a I.V. of above 25, the ratio of cis to trans isomers has been found to be less critical unless very high concentrations are needed.

Other examples of suitable quaternary ammoniums of Formula (III) and (IV) are obtained by, e.g., —replacing "tallow" in the above compounds with, for example, coco, palm, lauryl, oleyl, ricinoleyl, stearyl, palmityl, or the like, said fatty acyl chains being either fully saturated, or preferably at least partly unsaturated;

—replacing "methyl" in the above compounds with ethyl, ethoxy, propyl, propoxy, isopropyl, butyl, isobutyl or t-butyl;

—replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably from about 15% to about 35%.

For the preceding fabric softening agents, the pH of the compositions herein is an important parameter of the present invention. Indeed, it influences the stability of the quaternary ammonium or amine precursors compounds, especially in prolonged storage conditions.

The pH, as defined in the present context, is measured in the neat compositions at 20° C. For optimum hydrolyric stability of these compositions, the neat pH, measured in the above-mentioned conditions, must be in the range of from about 2.0 to about 4.5, preferably from about 2.0 to about 3.5. The pH of these compositions herein can be regulated by the addition of a Bronsted acid.

Examples of suitable acids include the inorganic mineral acids, carboxylic acids, in particular the low molecular weight (C1–5) carboxylie acids, and alkylsulfonic acids. Suitable inorganic acids include HCl, $H_2SO_4$, $NHO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Softening agents also useful in the compositions of the present invention are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being laurie acid, myristic acid, palmitic acid, stearic acid, oleic and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or rioesters, preferably mono-, are preferred herein (e.g. polyglycerol monostearate with a trade name of Radiasurf 7248).

Useful glycerol and polyglycerol esters include monoesters with stearic, oleic, palmitic, laurie, isostearic, myristic, and/or behenic acids and the diesters of stearic, oleic, palmitic, laurie, isostearic, behenic, and/or myristic acids. It is understood that the typical mono-ester contains some di-and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Bums, issued Mar. 27, 1984; and in U.S. Pat. Nos.: 3,861,870, Edwards and Diehl; 4,308,151, Cambre; 3,886,075, Bernardino; 4,233,164, Davis; 4,401,578, Verbruggen; 3,974,076, Wiersema and Rieke; 4,237,016, Rudkin, Clint, and Young; and European Patent Application publication No. 472,178, by Yamamura et al., all of said documents being incorporated herein by reference.

For example, suitable fabric softener agents useful herein can comprise one, two, or all three of the following fabric softening agents: (a) the reaction product of higher fatty acids with a polyamine selected from the group consisting of hydroxyalkylalkylenediamines and dialkylenetriamines and mixtures thereof(preferably from about 10% to about 80%); and/or (b) cationic nitrogenous salts containing only one long chain acyclic aliphatic $C_{15}$–C22 hydrocarbon group (preferably from about 3% to about 40%); and/or (c) cationic nitrogenous salts having two or more long chain acyclic aliphatic $C_{15}$–C22 hydrocarbon groups or one said group and an arylalkyl group (preferably from about 10% to about 80%); with said (a), (b) and (c) preferred percentages being by weight of the fabric softening agent component of the present invention compositions.

Following are the general descriptions of the preceding (a), (b), and (c) softener ingredients (including certain specific examples which illustrate, but do not limit the present invention).

Component (a): Softening agents (actives) of the present invention can be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyarnines.

The preferred Component (a) is a nitrogenous compound selected from the group consisting of the reaction product mixtures or some selected components of the mixtures. More specifically, the preferred Component (a) is compounds selected from the group consisting of substituted imidazoline compounds having the formula:

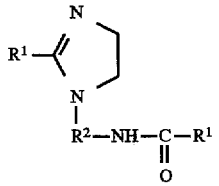

wherein $R^1$ is an acyclic aliphatic $C_{15}$–$C_{21}$ hydrocarbon group and $R^2$ is a divalent $C_1$–$C_3$ alkylene group.

Component (a) materials are commercially available as: Mazamide® 6, sold by Mazer Chemicals, or Ceranine® HC, sold by Sandoz Colors & Chemicals; stearic hydroxyethyl imidazoline sold under the trade names of Alkazine® ST by Alkaril Chemicals, Inc., or Schercozoline® S by Scher Chemicals, Inc.; N,N"-ditallowalkoyldiethylenetriamine; 1-tallowamidoethyl-2-tallowimidazoline (wherein in the preceding structure $R^1$ is an aliphatic $C_{15}$ . $C_{17}$ hydrocarbon group and $R^2$ is a divalent ethylene group).

Certain of the Components (a) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amidoethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Warisoft® 475.

Component (b): The preferred Component (b) is a cationic nitrogenous salt containing one long chain acyclic aliphatic $C_{15}$–$C_{22}$ hydrocarbon group, preferably selected from acyclic quaternary ammonium salts having the formula:

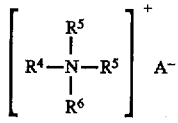

wherein $R^4$ is an acyclic aliphatic $C_{15}$–$C_{22}$ hydrocarbon group, $R^5$ and $R^6$ are $C_1$–$C_4$ saturated alkyl or hydroxy alkyl groups, and A- is an anion.

Examples of Component (b) are the monoalkyltrimethylammonium salts such as monotallowtrimethylammonium chloride, mono(hydrogenated tallow)trimethylammonium chloride, palmityltrimethyl ammonium chloride and soyatrimethylammonium chloride, sold by Witco Chemical Company under the trade name Adogen® 471, Adogen® 441, Adogert® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred.

Other examples of Component (b) are behenyltrimethylammonium chloride wherein $R^4$ is a $C_{22}$ hydrocarbon group and sold under the trade name Kemamine® Q2803-C by Humko Chemical Division of Witco Chemical Corporation; soyadimethylethylammonium ethylsulfate wherein $R^4$ is a $C_{16}$–$C_{18}$ hydrocarbon group, $R^5$ is a methyl group, $R^6$ is an ethyl group, and A- is an ethylsulfate anion, sold under the trade name Jordaquat® 1033 by Jordan Chemical Company; and methyl-bis(2-hydroxyethyl)-octadecylammonium chloride wherein $R^4$ is a $C_{18}$ hydrocarbon group, $R^5$ is a 2-hydroxyethyl group and $R^6$ is a methyl group and available under the trade name Ethoquad® 18/12 from Armak Company.

Other examples of Component (b) are 1-ethyl-1-(2-hydroxy ethyl)-2-isoheptadecylimidazolinium ethylsulfate, available from Mona Industries, Inc. under the trade name Monaquat® ISIES; mono(tallowoyloxyethyl) hydroxyethyldimethylammonium chloride, i.e., monoester of tallow fatty acid with di(hydroxyethyl)dimethylammonium chloride, a by-product in the process of making diester of tallow fatty acid with di(hydroxyethyl)dimethylammonium chloride, i.e., di(tallowoyloxyethyl) dimethylammonium chloride.

Component (c): Preferred cationic nitrogenous salts having two or more long chain acyclic aliphatic $C_{15}$–$C_{22}$ hydrocarbon groups or one said group and an arylalkyl group which can be used either alone or as part of a mixture are selected from the group consisting of:

(i) acyclic quaternary ammonium salts having the formula:

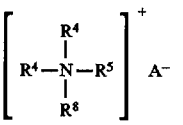

wherein $R^4$ is an acyclic aliphatic $C_{15}$–$C_{22}$ hydrocarbon group, $R^5$ is a $C_1$–$C_4$ saturated alkyl or hydroxyalkyl group, R8 is selected from the group consisting of $R^4$ and $R^5$ groups, and A- is an anion defined as above;

(ii) diamido quaternary ammonium salts having the formula:

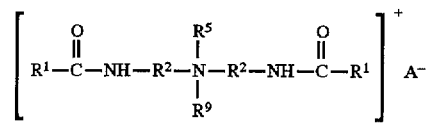

wherein $R^1$ is an acyclic aliphatic $C_{15}$–$C_{21}$ hydrocarbon group, each $R^2$ is the same or different divalent alkylene group having 1 to 3 carbon atoms, $R^5$ and R9 are $C_1$–$C_4$ saturated alkyl or hydroxyalkyl groups, and A- is an anion;

(iii) diamino alkoxylated quaternary ammonium salts having the formula:

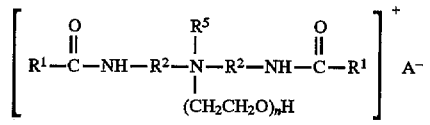

wherein n is equal to 1 to about 5, and $R^1$, $R^2$, $R^5$ and A- are as defined above;

(iv)

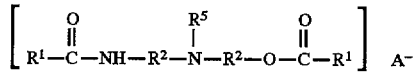

wherein $R^1$ is an acyclic aliphatic $C_{15}$–$C_{21}$ hydrocarbon group, $R^2$ is the same or different divalent alkylene group having 1 to 3 carbon atoms, $R^5$ are $C_1$–$C_4$ saturated alkyl or hydroxyalkyl groups, A- is an anion and $R^2$ is the same or different from the other $R^2$.

(v) mixtures thereof.

Examples of Component (c) are the well-known dialkyldi methylammonium salts such as ditallowdimethylammonium chloride, ditallowdimethylammonium methylsulfate, di(hydrogenatedtallow)dimethylammonium chloride, distearyldimethylammonium chloride, dibehenyldimethylammonium chloride. Di(hydrogenatedtallow)di methylammonium chloride and ditallowdimethylammonium chloride are preferred. Examples of commercially available dialkyldimethyl ammonium in salts usable the present invention are di(hydrogenatedtallow)dimethylammonium chloride (trade name Adogen® 442), ditallowdimethylammonium chloride (trade name Adogert® 470), distearyl dimethylammonium chloride (trade name Arosurf® TA-100), all available from Witco Chemical Company. Dibehenyldimethylammonium chloride is sold under the trade name Kemamine Q-2802C by Hurnko Chemical Division of Witco Chemical Corporation.

Other examples of Component (c) are methylbis (tallowamidoethyl)(2-hydroxyethyl)ammonium methylsulfate and methylbis(hydrogenated tallowamidoethyl)(2-hydroxyethyl)ammonium methylsulfate; these materials are available from Witco Chemical Company under the trade names Varisoft® 222 and Varisoft® 110, respectively: dimethylstearylbertzyl ammonium chloride sold under the trade names Varisoft® SDC by Witco Chemical Company and Ammonyx® 490 by Onyx Chemical Company.

An even more preferred composition contains Component (a): the reaction product of about 2 moles of hydrogenated tallow fatty acids with about 1 mole of N-2-hydroxyethylethylenediamine and is present at a level of from about 20% to about 70% by weight of the fabric softening component of the present invention compositions; Component (b): mono(hydrogenated tallow)trimethyl ammonium chloride present at a level of from about 3% to about 30% by weight of the fabric softening component of the present invention compositions; Component (c): selected from the group consisting of di(hydrogenatedtallow) dimethylammonium chloride, ditallowdimethylammonium chloride, methyl-1-tallowamidoethyl-2-tallowimidazolinium methylsulfate, diethanol ester dimethylammonium chloride, and mixtures thereof, wherein Component (c) is present at a level of from about 20% to about 60% by weight of the fabric softening component of the present invention compositions; and wherein the weight ratio of said di(hydrogenated tallow)dimethylammonium chloride to said methyl-1-tallowamidoethyl-2-tallowimidazolinium methylsulfate is from about 2:1 to about 6:1.

In the cationic nitrogenous salts described hereinbefore, the anion A- provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion A-.

The preferred fabric softening compounds of the present invention are biodegradable quaternary ammonium compounds according to II and III as hereinbefore described, wherein, preferably, the fatty acyl groups have an Iodine Value (I.V.) of from greater than about 5 to less than about 100, and, also preferably, a cis/trans isomer weight ratio of greater than about 3/7 when the I.V. is less than about 25, the level of unsaturation preferably being less than about 65% by weight. Preferably, the compounds with an I.V. of greater than about 10 are capable of forming concentrated aqueous compositions with concentrations greater than about 13% by weight without viscosity modifiers other than normal polar organic solvents present in the raw material of the compound or added electrolyte, and wherein any fatty acyl groups from tallow are preferably modified, especially to reduce their odor.

When the I.V. of the fatty acyl groups is above about 20, the softener provides excellent antistatic effect. Antistatic effects are especially important where the fabrics are dried in a tumble dryer, and/or where synthetic materials which generate static are used. Maximum static control occurs with an I.V. of greater than about 20, preferably greater than about 40. When fully saturated softener compounds are used in the compositions, poor static control results. Also, as discussed hereinafter, concentratability increases as I.V. increases. The benefits of concentratability include: use of less packaging material; use of less organic solvents, especially volatile organic solvents; use of less concentration aids which typically add nothing to performance; etc.

As the I.V. is raised, there is a potential for odor problems. Surprisingly, some highly desirable, readily available sources of fatty acids such as tallow, possess odors that remain with the softener compounds despite the chemical and mechanical processing steps which convert the raw tallow to finished active. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior concentratability and/or performance. For example, diester quaternary ammonium salt (DEQA) containing unsaturated fatty acyl groups having an I.V. greater than about 10 can be concentrated above about 13% without the need for additional concentration aids, especially surfactant concentration aids as discussed hereinafter.

The above softener actives derived from highly unsaturated fatty acyl groups, i.e., fatty acyl groups having a total unsaturation above about 65% by weight, do not provide any additional improvement in antistatic effectiveness. They may, however, be able to provide other benefits such as improved water absorbency of the fabrics. In general, an I.V. range of from about 40 to about 65 is preferred for concentratability, maximization of fatty acyl sources, excellent softness, static control, etc.

Highly concentrated aqueous dispersions of these softener compounds can gel and/or thicken during low (5° C.) temperature storage. Softener compounds made from only unsaturated fatty acids minimizes this problem but additionally is more likely to cause malodor formation. Surprisingly, compositions from these softener compounds made from fatty acids having an I.V. of from about 5 to about 25, preferably from about 10 to about 25, more preferably from about 15 to about 20, and a cis/trans isomer weight ratio of from greater than about 3/7 preferably greater than about 5/5, more preferably greater than about 7/3, are storage stable at low temperature with minimal odor formation. These cis/trans isomer weight ratios provide optimal concentratability at these I.V. ranges. In the I.V. range above about 25, the ratio of cis to trans isomers is less important unless higher concentrations are needed. The relationship between I.V. and concentratability is described hereinafter. For any IV, the concentration that will be stable in an aqueous composition will depend on the criteria for stability (e.g., stable down to about 5° C.; stable down to 0° C.; doesn't gel; gels but recovers on heating, etc.) and the other ingredients present, but the concentration that is stable can be raised by adding the concentration aids, described hereinafter in more detail, to achieve the desired stability.

Generally, hydrogenation of fatty acids to reduce polyunsaturation and to lower I.V. to insure good color and improve odor and odor stability leads to a high degree of trans configuration in the molecule. Therefore, diester compounds derived from fatty acyl groups having low I.V. values can be made by mixing fully hydrogenated fatty acid with touch hydrogenated fatty acid at a ratio which provides an I.V. of from about 5 to about 25. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high Ha availability, etc. Touch hardened fatty acid with high cis/trans isomer weight ratios is available commercially (i.e., Radiacid 406 from FINA).

It has also been found that for good chemical stability of the diester quaternary compound in molten storage, moisture level in the raw material must be controlled and minimized preferably less than about 1% and more preferably less than about 0.5% water. Storage temperatures should be kept as low as possible and still maintain a fluid material, ideally in the range of from about 49° C. to about 66° C. The optimum storage temperature for stability and fluidity depends on the specific I.V. of the fatty acid used to make the softener compound and the level/type of solvent selected. It is important to provide good molten storage stability to provide a commercially feasible raw material that will not degrade noticeably in the normal transportation/storage/handling of the material in manufacturing operations.

It will be understood that substituents R and $R^1$ can optionally be substituted with various groups such as alkoxyl or hydroxyl groups. The preferred compounds can be considered to be diester variations of ditallow dimethyl ammonium chloride (DTDMAC), which is a widely used fabric softener. At least 80% of the softener compound, i.e., DEQA is preferably in the diester form, and from 0% to about 20%, preferably less than about 10%, more preferably less than about 5%, can be monoester, i.e., DEQA monoester (e.g., containing only one —Y—$R^1$ group).

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

In addition, since the foregoing compounds (diesters) are somewhat labile to hydrolysis, they should be handled rather carefully when used to formulate the compositions herein. For example, stable liquid compositions herein are formulated at a pH (neat) in the range of from about 2 to about 5, preferably from about 2 to about 4.5, more preferably from about 2 to about 4. For best product odor stability, when the I.V. is greater that about 25, the neat pH is from about 2.8 to about 3.5, especially for lightly scented products. This appears to be true for all of the above softener compounds and is especially true for the preferred DEQA specified herein, i.e., having an I.V. of greater than about 20, preferably greater than about 40. The limitation is more important as I.V. increases. The pH can be adjusted by the addition of a Bronsted acid. pH ranges for making chemically stable softener compositions containing diester quaternary ammonium fabric softening compounds are disclosed in U.S. Pat. No. 4,767,547, Straathof et al., issued on Aug. 30, 1988, which is incorporated herein by reference.

Examples of suitable Bronsted acids include the inorganic mineral acids, carboxylic acids, in particular the low molecular weight (C1–C5) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, and citric acids.

Liquid compositions of this invention typically contain from about 0.5% to about 80%, preferably from about 1% to about 35%, more preferably from about to about 32%, of biodegradable diester quaternary ammonium softener active. Concentrated compositions are disclosed in allowed U.S. patent application Ser. No. 08/169,858, filed Dec. 17, 1993, Swartley, et al., said application being incorporated herein by reference.

Particulate solid, granular compositions of this invention typically contain from about 50% to about 95%, preferably from about 60% to about 90% of biodegradable diester quaternary ammonium softener active.

The amount of fabric softening agent (fabric softener) in liquid compositions of this invention is typically from about 2% to about 50%, preferably from about 4% to about 30%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

Fully formulated fabric softening compositions preferably contain, in addition to the hereinbefore described components, one or more of the following ingredients.

Concentrated compositions of the present invention may require organic and/or inorganic concentration aids to go to even higher concentrations and/or to meet higher stability standards depending on the other ingredients. Surfactant concentration aids are typically selected from the group consisting of single long chain alkyl eationic surfactants; nonionic surfactants; amine oxides; fatty acids; or mixtures thereof, typically used at a level of from 0 to about 15% of the composition. Inorganic viscosity/dispersibility control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carded over from the main wash, in the rinse, and on the fabrics, and can improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 80%, by weight of the carrier. The level of liquid carrier is greater than about 50%, preferably greater than about 65%, more preferably greater than about 70%. Mixtures of water and low molecular weight, e.g., <about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Stabilizers can be present in the compositions of the present invention. The term "stabilizer," as used herein, includes antioxidants and reductive agents both of which are well-known in the art. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially desirable for low scent products (low perfume).

Optionally, the compositions of the present invention can contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. These agents give additional stability to the concentrated aqueous, liquid compositions. Therefore, their presence in such liquid compositions, even at levels which do not provide soil release benefits, is preferred.

Preferred soil release agents include a copolymer having blocks of terephthalate and polyethylene oxide, crystallizable polyesters and polymers of the generic formula:

$$X—(OCH_2CH_2)_n—(O—C(O)—R^1—C(O)—O—R^2)_u—(O—C(O)—R^1—C(O)—O)—(CH_2CH_2O)_n—X$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. $R^2$ can be any suitable ethylene or substituted ethylene moieties. A more complete disclosure of these highly preferred soil release agents is contained in European Patent Application 185,427, Gosselink, published Jun. 25, 1986, the disclosure of which is incorporated herein by reference.

Detersive Surfactant

Detersive surfactants can be included in the compositions of the present invention. Such compositions may comprise at least 1%, preferably from about 1% to about 99.8%, by weight of surfactant depending upon the particular surfactants used and the effects desired. In a highly preferred embodiment, the detersive surfactant comprises from about 5% to about 80% by weight of the composition.

The detersive surfactant can be nonionic, artionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants. Nonlimiting examples of surfactants useful herein include the conventional $C_{11}$–$C_{18}$ alkyl benzene sulfonates and primary, secondary and random alkyl sulfates, the $C_{10}$–$C_{18}$ alkyl alkoxy sulfates, the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. Other conventional useful surfactants are listed in standard texts.

One class of nonionic surfactant particularly useful in detergent compositions of the present invention is condensates of ethylene oxide with a hydrophobic moiety to provide a surfactant having an average hydrophilic-lipophilic balance (HLB) in the range of from 5 to 17, preferably from 6 to 14, more preferably from 7 to 12. The hydrophobic (lipophilic) moiety may be aliphatic or aromatic in nature. The length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the C9–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol, the $C_{12}$–$C_{15}$ primary alcohols containing 3–5 moles of ethylene oxide per mole of alcohol, and mixtures thereof.

Another suitable class of nonionic surfactants comprises the polyhydroxy fatty acid amides of the formula:

$$R^2C(O)_n(R^1)Z$$

wherein: $R^1$ is H, C1–C8 hydrocarbyl, 2-hydroxyethyl, 2-hydroxypropyl, or a mixture thereof, preferably $C_1$–$C_4$ alkyl, more preferably $C_1$ or C2 alkyl, most preferably $C_1$ alkyl (i.e., methyl); and $R^2$ is a C5-C32 hydrocarbyl moiety, preferably straight chain C7-C19 alkyl or alkenyl, more preferably straight chain C9-C17 alkyl or alkenyl, most preferably straight chain $C_{11}$–C19 alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_n—1—CH_2OH$, $—CH_2—(CHOH)_2(CHOR^2)(CHOH)—CH_2OH$, where n is an integer from 1 to 5, inclusive, and $R^2$ is H or a cyclic mono- or polysaccharide, and alkoxylated derivatives thereof. Most preferred are glycityls wherein n is 4, particularly $—CH_2—(CHOH)_4—CH_2OH$.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSixO_2x+1.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$Mzx(zAlO_2)y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krurnmel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, I0 the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly allcyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloiysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the compositions of the present invention are the 3,3-dicarboxy4-oxa-1,6-hexanedioates and the related compounds disclosed in U.S. Pat. No. 4,566,984, Bush, issued Jan. 28, 1986. Useful succinic acid builders include the C5–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehi, issued Mar. 7, 1967. See also Diehi U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1, 1-diphosphonate and other known phosphonates (see, for example, U.S. Pat. Nos. 3,159,581; 3,213,030; 3,422,021; 3,400,148 and 3,422,137) can also be used.

Bleaching Compounds

The compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4- oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Bums et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Bums et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)_n(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

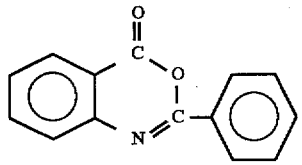

Still another class of preferred bleach activators includes the acyl lactam activators, especially acyl caprolactams and acyl valerolactams of the formulae:

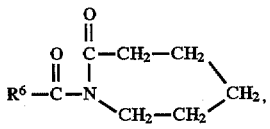

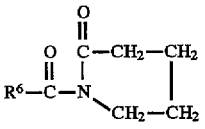

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganesebased catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include MnIV2(μ-O)3(1,4,7-trimethyl-1,4,7-triazacyclononane)$_2$(PF6)$_2$, MnII2(μ-O)1(μ-OAc)$_2$(1,4,7-trimethyl-1,4,7-triazacyclononane)$_2$-(ClO4)$_2$, MnIV4(μ-O)6(1,4,7-triazacyclononane)4(ClO4)4, MnIIIMnIV4(μ-O)1(μ-OAc)$_2$-(1,4,7-trimethyl-1,4,7-triazacyclononane)$_2$(ClO4)3, MnIV(1,4,7-trimethyl-1,4,7-triazacyclononane)- (OCH3)3(PF6), and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the compositions of the present invention for a variety of purposes, including removal of protein-based, carbohydrate-based, or triglyceride-based stains from surfaces such as textiles or dishes, for the prevention of refugee dye transfer, for example in laundering, and for fabric restoration. Suitable enzymes include proteases, amylases, lipases, cellulases, peroxidases, and mixtures thereof of any suitable origin, such as vegetable, animal, bacterial, fungat and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents, such as in automatic dishwashing, it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble. When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of and no acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, 135, +156, +166, +195, +197, +204, +206, +210, +216, +217, +218, +222, +260, 265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein, especially for, but not limited to automatic dishwashing purposes, include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediandne in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Baccillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. lichenifonnis* alpha-amylase, known as TERMAMYL®, or the homologous position variation of a similar parent amylase, such as *B. amyloliquefaciens, B. subtilis,* or *B. stearothermophilus;* (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 94183 14 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® (Novo) is especially useful. See also WO 9117243 to Novo.

Suitable lipase enzymes for detergent usage include those produced by microorganisms of the Pseudomonas group, such as Pseudomonas stutzeri ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex Chromobatter viscosum, e.g. Chromobacter viscosum vat. lipolyticum NRRLB 3673 from Toyo Jozo Co., Tagata, Japan; Chromobacter viscosum lipases from U.S. Biochemical Corp., U.S.A. and Disoynth Co., The Netherlands, and lipases ex Pseudomonas gladioli. LIPOLASE® enzyme derived from Humicola lanuginosa and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Cutinase enzymes suitable for use herein are described in WO 8809367 A to Genencor.

Peroxidase enzymes can be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

Enzyme-containing, including but not limited to, liquid compositions, herein can comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium realate, calcium maleate, calcium hydroxide and calcium acetate; more generally, calcium sulfate or magnesium salts corresponding to the exemplified calcium salts can be used. Further increased levels of Calcium and/or Magnesium may of course be useful, for example for promoting the grease-cutting action of certain types of surfactant.

Another stabilizing approach is by use of borate species. See Severson, U.S. Pat. No. 4,537,706. Borate stabilizers, when used, can be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions, for example automatic dish washing compositions, may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during dish- or fabric-washing, can be relatively large; accordingly, enzyme stability to chlorine in-use is sometimes problematic. Since perborate or percarbonate, which have the ability to react with chlorine bleach, may present in certain of the instant compositions in amounts accounted for separately from the stabilizing system, the use of additional stabilizers against chlorine, may, most generally, not be essential, though improved results may be obtainable from their use. Suitable chlorine scavenger artions are widely known and readily available, and, if used, can be salts containing ammonium cations with sulfite, bisulfite, thiosulfite, thiosulfate, iodide, etc. Antioxidants such as carbamate, astorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Other Optional Ingredients

Other preferred optional ingredients include polymeric soil release agents, materials effective for inhibiting the transfer of dyes from one fabric to another during the cleaning process (i.e., dye transfer inhibiting agents), polymeric dispersing agents, suds suppressors, optical brighteners or other brightening or whitening agents, chelating agents, fabric softening clay, anti-static agents, other active ingredients, carriers, hydrotropes, processing aids, dyes or pigments, solvents for liquid formulations, solid fillers for bar compositions,, bacteriocides, colorants, perfumes, preservatives, opacifiers, stabilizers such as guar gum and polyethylene glycol, anti- shrinkage agents, anti-wrinkle agents, fabric crisping agents, spotting agents, germicides, fungicides, anti-corrosion agents, and the like.

Liquid compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carders.

Process

Granular compositions can be prepared, for example, by spray-drying (final product density about 520 g/l) or agglomerating (final product density above about 600 g/l) the Base Granule. The remaining dry ingredients can then be admixed in granular or powder form with the Base Granule, for example in a rotary mixing drum, and the liquid ingredients (e.g., nonionic surfactant and perfume) can be sprayed on.

The granular fabric softening compositions of the present invention can be formed by preparing a melt, solidifying it by cooling, and then grinding and sieving to the desired size. In a three-component mixture, e.g. nonionic surfactant, single-long-chain cationic, and DEQA, it is more preferred, when forming the granules, to pre-mix the nonionic surfactant and the more soluble single-long-chain alkyl cationic compound before mixing in a melt of the diester quaternary ammonium cationic compound.

It is highly preferred that the primary particles of the granules have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

Method of Use

In use, water can be added to the particulate, solid, granular compositions to form dilute or concentrated liquid softener compositions for later addition to the rinse cycle of the laundry process with a concentration of said biodegradable cationic softening compound of from about 0.5% to about 50%, preferably from about 1% to about 35%, more preferably from about 4% to about 32%,. The particulate, rinse-added solid composition (1) can also be used directly in the rinse bath to provide adequate usage concentration (e.g., from about 10 to about 1,000 ppm, preferably from about 50 to about 500 ppm, of total softener active ingredient). The liquid compositions can be added to the rinse to provide the same usage concentrations.

The water temperature for preparation should be from about 20° C. to about 90° C., preferably from about 25° C. to about 80° C. Single-long-chain alkyl cationic surfactants as the viscosity/dispersibility modifier at a level of from 0% to about 15%, preferably from about 3% to about 15%, more preferably from about 5% to about 15%, by weight of the composition, are preferred for the solid composition. Nonionic surfactants at a level of from about 5% to about 20%, preferably from about 8% to about 15%, as well as mixtures of these agents can also serve effectively as the viscosity/dispersibility modifier.

The emulsified/dispersed particles, formed when the said granules are added to water to form aqueous concentrates, typically have an average particle size of less than about 10 microns, preferably less than about 2 microns, and more preferably from about 0.2 to about 2 microns, in order that effective deposition onto fabrics is achieved. The term "average particle size," in the context of this specification, means a number average particle size, i.e., more than 50% of the particles have a diameter less than the specified size.

Particle size for the emulsified/dispersed particles is determined using, e.g., a Malvern particle size analyzer.

If the composition of the present invention includes a detergent or surfactant, the compositions herein will preferably be formulated such that, during use in aqueous cleaning operations, the wash water will have a pH of between about 6.5 and about 11, preferably between about 7.5 and 10.5. Laundry products are typically at pH 9–11. Techniques for controlling pH at recommended usage levels include the use of buffers, alkalis, acids, etc., and are well known to those skilled in the art.

EXAMPLES

The following examples illustrate the sulfonates and compositions of this invention, but are not intended to be limiting thereof.

Example 1

Phenoxanyl p-toluenesulfonate

Phenoxanol (30.00 g, 0.168 mol) and pyridine (130 mL) are combined in a flask fitted with a condenser, internal thermometer, mechanical stirrer and argon inlet. The solution is cooled to −10° C. and to it is added p-toluenesulfonyl chloride (39.28 g, 0.202 tool) in portions via Gooch tubing so as to maintain the reaction temperature between −10°–0° C. After 3 h, water (20 mL) is added in portions so as to keep the temperature of the reaction below 5° C. The reaction mixture is warmed to room temperature and then poured into a separatory funnel containing 275 mL of ether. The layers are separated and the organic layer is washed with 5 M $H_2SO_4$ (75 mL), saturated $CuSO_4$ solution (75 mL), water (2×75 mL) and saturated NaHCO3 solution (75 mL). After drying over MgSO4, the organic layer is filtered and concentrated to leave a light yellow liquid as phenoxanyl p-toluenesulfonate. Purity of the product is determined by thin layer chromatography and the structure confirmed by 1H and 13C NMR.

Example 2 b-Citronellyl p-toluenesulfonate b-Citronellol (21.05 g, 0.128 mol) and tetrahydrofuran (140 mL) are combined in a flask fitted with a condenser, internal thermometer, mechanical stirrer and argon inlet. The solution is cooled to −78° C. and to it is added n-butylithium (56.3 mL, 0.141 tool, 2.5 M in hexanes) via syringe. The mixture is stirred for 60 rain before a solution of p-tohenesulfonyl chloride (39.28 g, 0.2019 tool) dissolved in 50 mL of tetrahydrofuran is added. After addition is complete, the mixture is stirred for 30 min at −78° C. and then at room temperature overnight. Ether (100 mL) is added and the mixture is quenched with water (100 mL). The organic layer is dried over MgSO4, filtered and concentrated to leave a yellow-orange liquid. The oil is purified on silica gel eluting with 20% ethyl acetate in petroleum ether to give a light yellow liquid as b-citronellyl p-toluenesulfonate. Purity of the product is determined by thin layer chromatography and the structure confirmed by 1H and 13C NMR.

Example 3

2-Ethylhexanyl p-toluenesulfonate

2-Ethylhexanol (50.51 g, 0.384 tool) and pyridine (260 mL) are combined in a flask fitted with a condenser, internal thermometer, mechanical stirrer and argon inlet. The solution is cooled to −5° C. and to it is added p-toluenesulfonyl chloride (89.63 g, 0.416 mol) in portions via Gooch tubing so as to maintain the reaction temperature −5°–5° C. After 3 h, (40 mL) is added in portions so as to keep the temperature of the reaction below 5° C. The reaction mixture is warmed to room temperature and then poured into a separatory funnel containing 540 mL of ether. The layers are separated and the organic layer is washed with 5 M $H_2SO_4$ (2×140 mL), saturated CuSO4 solution (140 mL), water (2×140 mL) and saturated NaHCO3 solution (140 mL). After drying over MgSO4, the organic layer is filtered, and concentrated to leave a light yellow liquid as 2-ethyhexanyl p-toluenesulfonate. Purity of the product is determined by thin layer chromatography and the structure confirmed by 1H and 13C NMR.

Example 4

2-Ethylhexanyl 4-bromobenzenesulfonate

The procedure for Example 3 is repeated with the substitution of 4 bromobenzenesulfonyl chloride for potoluenesulfonyl chloride.

Example 5

Phenoxanyl methanesulfonate

The procedure for Example 1 is repeated with the substitution of methanesulfonyl chloride for p-toluenesulfonyl chloride.

Example 6

Liquid fabric softener compositions according to the present invention are formulated as follows:

| Ingredient | A Wt. % | B Wt. % | C Wt. % | D Wt. % | E Wt. % |
|---|---|---|---|---|---|
| DEQA (1) | 25.0 | 25.0 | 25.0 | 24.0 | 24.0 |
| Ethanol | 4.0 | 4.0 | 4.0 | 4.27 | 4.27 |
| HCl | 0.01 | 0.01 | 0.01 | 0.74 | 0.01 |
| CaCl2 | 0.46 | 0.46 | 0.46 | 0.75 | 0.46 |
| Silicone Antifoam (2) | 0.15 | 0.15 | 0.15 | 0.10 | 0.15 |
| Chelant (3) | — | — | — | 2.50 | 2.50 |
| Soil Release Polymer | — | — | — | 0.50 | 0.50 |
| Ammonium Chloride | — | — | — | 0.10 | 0.10 |
| Preservative (4) | 0.0003 | 0.0003 | 0.0003 | 0.0003 | 0.0003 |
| Conventional Perfume | 1.20 | 1.00 | 1.35 | 1.30 | 1.30 |
| phenoxanyl p-toluene-sulfonate | 1.20 | | | | |
| b-citronellyl p-toluene-sulfonate | | 1.20 | | | |
| 2-ethylhexanyl p-toluene-sulfonate | | | 1.20 | | |
| 2-ethylhexanyl 4-bromo-benzenesulfonate | | | | 1.20 | |
| phenoxanyl methane-sulfonate | | | | | 1.20 |
| Water | * | * | * | * | * |

(1) Di-(soft-tallowyloxyethyl) dimethyl ammonium chloride
(2) DC-2310, sold by Dow-Corning
(3) Diethylenetrinitrilopentaacetic acid
(4) Kathon CG, sold by Rohm & Haas
*balance

Example 7

Additional liquid fabric conditioner formulas include the following.

| Ingredient | F Wt. % | G Wt. % | H Wt. % | I Wt. % | J Wt. % |
|---|---|---|---|---|---|
| DEQA (5) | 5.40 | 18.16 | 18.16 | 22.7 | 22.7 |
| Poly(glycerol mono-stearate) | 0.83 | 2.40 | 2.40 | 3.00 | 3.00 |
| Tallow Alcohol Ethoxylate - 25 | 0.36 | 1.20 | 1.20 | 1.50 | 1.50 |
| HCl | 0.02 | 0.02 | 0.02 | 0.02 | 0.02 |
| CaCl2 | — | 0.20 | 0.20 | 0.30 | 0.30 |
| Silicone Anti-foam | — | 0.019 | 0.019 | 0.019 | 0.019 |
| Soil Release Polymer | — | 0.19 | 0.19 | 0.19 | 0.19 |
| Perfume | 0.187 | 0.70 | 0.70 | 0.90 | 0.90 |
| Blue Dye | 0.002 | 0.005 | 0.005 | 0.006 | 0.006 |
| phenoxanyl p-toluene-sulfonate? | 0.60 | 1.20 | | | |
| 2-ethylhexanyl 4-bromo-benzenesulfonate? | | | 0.60 | 1.20 | |
| phenoxanyl methane-sulfonate? | | | | | 1.20 |
| Water | * | * | * | * | * |

(5) Di-(tallowyloxyethyl) dimethyl ammonium chloride
*balance

Example 8

A fabric conditioner bar is prepared having the following components.

| Component | Wt. % |
|---|---|
| Co-Softener (6) | 70.00 |
| Neodol 45-13 (7) | 13.00 |
| Ethanol | 1.00 |
| Dye | 0.01 |
| Perfume | 0.75 |

-continued

| Component | Wt. % |
|---|---|
| phenoxanyl p-toluenesulfonate | 0.60 |
| Water | * |

(6) 1:2 Ratio of stearyidimethyl amine:triple-pressed stearic acid
(7) $C_{14}$–$C_{15}$ linear primary alcohol ethoxylate, sold by Shell Chemical Co.
*balance

What is claimed is:

1. Laundry and cleaning compositions comprising:

(a) an amount, effective to provide a perfume effect, of a perfume component selected from the group consisting of sulfonates having the formula (I), (II), or combinations thereof:

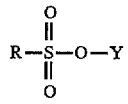

(I)

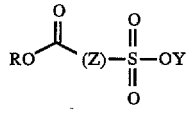

(II)

wherein R and Z are independently selected from the group consisting of nonionic or anionic, substituted or unsubstituted $C_1$–$C_{30}$ straight, branched or cyclic alkyl, alkenyl, alkynyl, alkylaryl or aryl group; Y is a radical that, upon hydrolysis of said sulfonate, forms an alcohol with a boiling point at 760 mm Hg of less than about 300° C. which are perfumes; and (b) ingredients useful for formulating laundry and cleaning compositions selected from the group consisting of cationic or nonionic fabric softening agents, enzymes, enzyme stabilizers, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof.

2. The laundry and cleaning compositions as claimed in claim 1, wherein said perfume component comprises from about 0.01% to about 10% by weight of said composition.

3. The laundry and cleaning composition as claimed in claim 1 wherein Y is a radical that upon hydrolysis of said sulfonate forms perfume alcohol selected from the group consisting of phenoxanol, floralol, β-citronellol, nonadol, cyclohexyl ethanol, phenyl ethanol, isoborneol, fenchol, isocyclogeraniol, (±)-linalool, dihydromyrcenol, 2-phenyl-1-propanol, 2-ethylhexanol, cis-3-hexenol, 3,7-dimethyl-1-octanol, and combinations thereof.

4. The laundry and cleaning composition as claimed in claim 3, wherein said sulfonate is selected from the tosylates, brosylates, and mesylates of said alcohol perfumes, and mixtures thereof.

5. The laundry and cleaning composition as claimed in claim 4 wherein said sulfonate is selected from the group of sulfonates derived from alcohol perfumes consisting of β-citronellol, phenoxanol, cis-3-hexenol, phenyl ethanol, and mixtures thereof.

6. A fabric softening composition comprising:

(a) an amount, effective to provide a perfume effect, of a perfume component selected from the group consisting of sulfonates having the formula (I), (II), or combinations thereof:

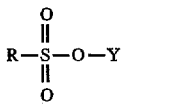

(I)

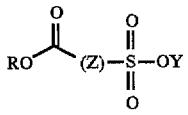

(II)

wherein R and Z are independently selected from the group consisting of nonionic or anionic, substituted or unsubstituted $C_1$–$C_{30}$ straight, branched or cyclic alkyl, alkenyl, alkynyl, alkylaryl or aryl group; Y is a radical that, upon hydrolysis of said sulfonate, forms an alcohol with a boiling point at 760 mm Hg of less than about 300° C. which are perfumes; and (b) a fabric softening component having at least one cationic or nonionic fabric softening agent.

7. The fabric softening composition as claimed in claim 6, wherein Y is a radical that upon hydrolysis of said sulfonate forms perfume alcohol selected from the group consisting of phenoxanol, floralol, β-citronellol, nonadol, cyclohexyl ethanol, phenyl ethanol, isoborneol, fenchol, isocyclogeraniol, (±)-linalool, dihydromyrcenol, 2-phenyl-1-propanol, 2-ethylhexanol, cis-3-hexenol, 3,7-dimethyl-1-octanol, and combinations thereof.

8. The fabric softening composition as claimed in claim 7 wherein said sulfonate is selected from the tosylates, brosylates, and mesylates of said alcohol perfumes.

9. The fabric softening composition as claimed in claim 8 wherein said sulfonate is selected from the group of sulfonates derived from alcohol perfumes consisting of β-citronellol, phenoxanol, cis-3-hexenol, phenyl ethanol, and mixtures thereof.

10. The fabric softening composition as claimed in claim 6 wherein said perfume component comprises from about 0.01% to about 10% by weight of said composition.

11. The fabric softening composition as claimed in claim 6 wherein said composition further includes at least one compound selected from the group consisting of viscosity/dispersibity modifiers, pH modifiers and liquid carriers.

12. The fabric softening composition as claimed in claim 11 wherein said composition includes a dispersibility modifier selected from the group consisting of: single-long-chain-$C_{10}$–$C_{22}$ alkyl, cationic surfactant; nonionic surfactant with at least 8 ethoxy moieties; amine oxide surfactant; quaternary ammonium salts of the general formula:

$$(R^2N^+R_3)\ X^-$$

wherein the $R^2$ group is a $C_{10}$–$C_{22}$ hydrocarbon group, or the corresponding ester linkage interrupted group with a short alkylene ($C_1$–$C_4$) group between the ester linkage and the N, and having a similar hydrocarbon group, each R is a $C_1$–$C_4$ alkyl or substituted alkyl, or hydrogen; and the counterion $X^-$ is a softener compatible anion, and mixtures thereof.

13. The fabric softening compositions as claimed in claim 6 wherein said fabric softening component is a cationic quaternary ammonium fabric softening compound.

14. The fabric softening composition as claimed in claim 13 wherein quaternary ammonium compound has the formula:

$$[(R)_{4-m}—^+N—((CH_2)_n—Y—R^2)_m]X^-$$

wherein: each Y is —O—(O)C—, or —C(O)—O—; m is 2 or 3; each n is independently chosen from 1 to 4; each R is a $C_1$–$C_6$ alkyl group, hydroxyalkyl group, benzyl group, or mixtures thereof, each $R^2$ is a $C_{12}$–$C_{22}$ hydrocarbyl or substituted hydrocarbyl substituent; and $X^-$ is any softener compatible anion.

15. The fabric softening composition as claimed in claim 14 wherein the quaternary ammonium compound is derived from $C_{12}$–$C_{22}$ fatty acyl groups having an Iodine Value of from greater than about 5 to less than about 100, a cis/trans isomer weight ratio of greater than about 30% when the Iodine Value is less than about 25, the level of unsaturation of the fatty acyl groups being less than about 65% by weight.

16. A fabric softening composition comprising:

(a) an amount, effective to provide a perfume effect, of a perfume component selected from the group consisting of sulfonates having the formula (I), (II), or combinations thereof:

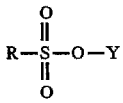

(I)

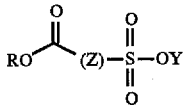

(II)

wherein R and Z are independently selected from the group consisting of nonionic or anionic, substituted or unsubstituted $C_1$–$C_{30}$ straight, branched or cyclic alkyl, alkenyl, alkynyl, alkylaryl or aryl group; Y is a radical that, upon hydrolysis of said sulfonate, forms an alcohol with a boiling point at 760 mm Hg of less than about 300° C. which are perfumes; and (b) a fabric softening component comprising a quaternary ammonium compound or amine precursor selected from the group consisting of:

(i) a compound having the formula:

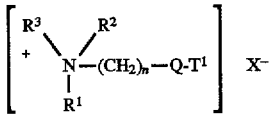

(III)

(ii) a compound having the formula:

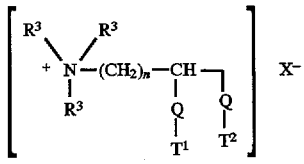

(IV)

wherein Q is —O—C(O)—or —C(O)—O— or —O—C(O)—O— or —$NR^4$C(O)— or —C(O)—$NR^4$—; $R^1$ is $(CH_2)_n$—Q—$T^2$ or $T^3$ or $R^3$; $R^2$ is $(CH_2)_m$—Q—$T^4$ or $T^5$ or $R^3$; $R^3$ is $C_1$–$C_4$ alkyl or $C_1$–$C_4$ hydroxyalkyl or H; $R^4$ is H or $C_1$–$C_4$ alkyl or $C_1$–$C_4$ hydroxyalkyl; $T^1$, $T^2$, $T^3$, $T^4$, $T^5$ are (the same or different) $C_{11}$–$C_{22}$ alkyl or alkenyl; n and m are integers from 1 to 4; and $X^-$ is a softener-compatible anion, the alkyl, or alkenyl, chain $T^1$, $T^2$, $T^3$, $T^4$, $T^5$ must contain at least 11 carbon atoms.

17. A method for laundering soiled fabrics, said method comprising contacting a fabric with an aqueous medium containing at least about 50 ppm of a laundry composition comprising:

(a) a perfume component selected from the group consisting of sulfonates having the formula (I), (II), or combinations thereof:

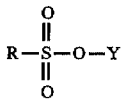

(I)

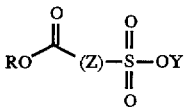

(II)

wherein R and Z are independently selected from the group consisting of nonionic or anionic, substituted or unsubstituted $C_1$–$C_{30}$ straight, branched or cyclic alkyl, alkenyl, alkynyl, alkylaryl or aryl group; Y is a radical that, upon hydrolysis of said sulfonate, forms an alcohol with a boiling point at 760 mm Hg of less than about 300° C. which are perfumes; and (b) ingredients useful for formulating laundry compositions selected from the group consisting of cationic or nonionic fabric softening agents, enzymes, enzyme stabilizers, detersive surfactants, builders, bleaching compounds, polymeric soil release agents, dye transfer inhibiting agents, polymeric dispersing agents, suds suppressors, optical brighteners, chelating agents, fabric softening clays, anti-static agents, and mixtures thereof.

18. The laundering method as claimed in claim 17 wherein said laundry composition further comprises cationic or nonionic fabric softening agents.

19. The laundering method as claimed in claim 18 wherein said perfume component comprises from about 0.01% to about 10% by weight of said composition.

* * * * *